US006419029B2

(12) United States Patent
Bayer et al.

(10) Patent No.: US 6,419,029 B2
(45) Date of Patent: Jul. 16, 2002

(54) DRILLING TOOL MAGAZINE

(75) Inventors: Hans-Joachim Bayer, Ettlingen; Günther Dörfler, Pfinztal; Alexander Steck, Stuttgart; Michael Keller, Aalen; Norbert Cottone, Steinenbronn; Uwe Bräuning, Stuttgart, all of (DE)

(73) Assignees: FlowTex® Technologie GmbH & Co. KG, Ettlingen; Fraunhofer-Gesellschaft zur Förderung der angewandten Forschung e.V., Munich, both of (DE)

( * ) Notice: Subject to any disclaimer, the term of this patent is extended or adjusted under 35 U.S.C. 154(b) by 0 days.

(21) Appl. No.: 09/280,153

(22) Filed: Mar. 26, 1999

(30) Foreign Application Priority Data

Mar. 27, 1998 (DE) ..... 198 13 698

(51) Int. Cl.[7] ..... E21B 19/14
(52) U.S. Cl. ..... 172/52; 414/22.62
(58) Field of Search ..... 175/52, 85; 166/77.51; 211/70.4; 414/22.53, 22.62

(56) References Cited

U.S. PATENT DOCUMENTS 3,193,084 A 7/1965 Bauer et al.
3,708,024 A * 1/1973 Back ..... 175/52
3,844,420 A 10/1974 Walling et al. ..... 214/1 P
3,976,149 A * 8/1976 Granholm et al. ..... 175/52
4,439,091 A * 3/1984 Frias ..... 414/745
4,445,579 A * 5/1984 Bello ..... 175/52
5,297,642 A * 3/1994 Rajakallio et al. ..... 175/85
5,607,280 A * 3/1997 Rozendaal ..... 414/745.7
6,074,153 A * 6/2000 Allen ..... 414/22.53

FOREIGN PATENT DOCUMENTS

DE 31 108 053 C2 10/1985
DE 37 38 116 A1 10/1987
GB 804799 11/1958

* cited by examiner

*Primary Examiner*—Robert E. Pezzuto
*Assistant Examiner*—Meredith C Petravick
(74) *Attorney, Agent, or Firm*—Fitch, Even, Tabin & Flannery

(57) ABSTRACT

A drilling tool magazine and a horizontal boring machine having a drilling tool magazine in which automatic and reliable handling and access to any of the drilling tools to be handled is ensured, the drilling tool magazine (10) which is particularly suitable for horizontal boring machines (5) is fitted with a plurality of tool bays (12) so as to receive tools (8) in an essentially horizontal position; these tool bays are each formed by at least one drive catch (14) movable along a conveyance path.

19 Claims, 7 Drawing Sheets

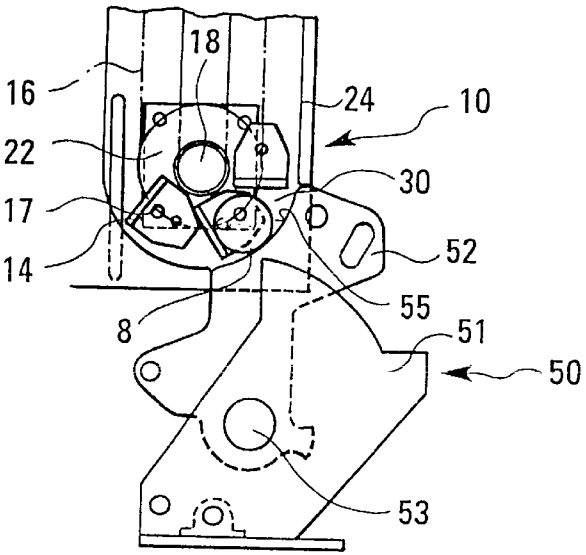
FIG.8
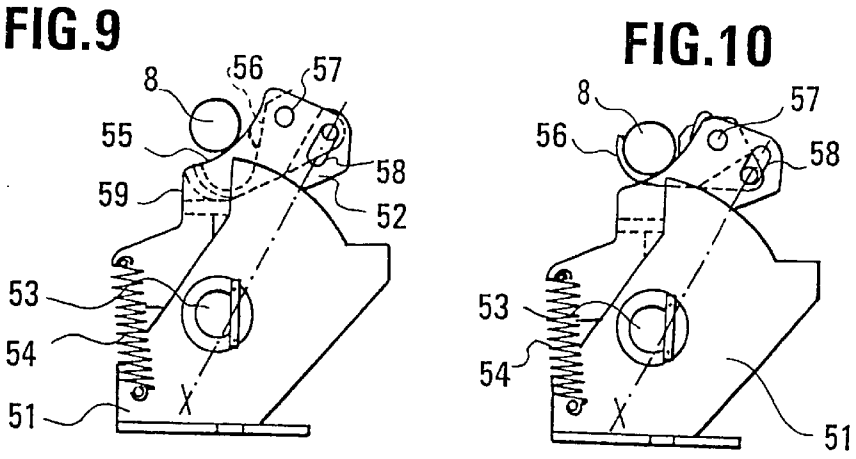
FIG.9
FIG.10
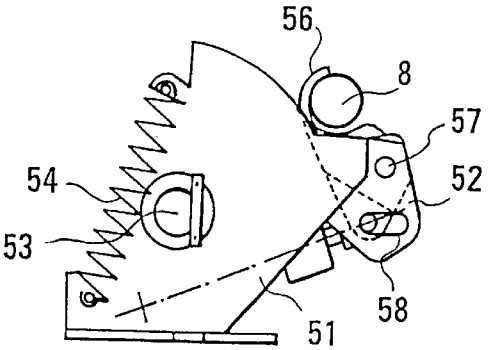
FIG.11

DRILLING TOOL MAGAZINE

TECHNICAL FIELD

The present invention relates to the storage, by means of a drilling tool magazine, of elongated tools and workpieces whose cross section is at least approximately circular, particularly for horizontal boring machines. The present invention also relates to a horizontal boring machine combined with such a drilling tool magazine.

PRIOR ART

Special-purpose drilling equipment and corresponding drilling techniques are used both in deep drilling engineering and in horizontal boring engineering for laying pipelines and cables without digging trenches. In this way, articulated rotating drilling tools are forced through the earth and after reaching the target they are rotationally withdrawn again.

The drilling tool used here comprises individual drilling rods which have threads at their ends and are screwed together at these threads. During drilling, the drilling tool is produced by screwing together the individual drilling rods. During the withdrawal operation, the tool has to be broken up again, i.e. the individual drilling rods have to be successively unscrewed from one another.

During the process of screwing and unscrewing, the drilling rods have to be held between the drilling drive and the end of the drilling tool. It is also advantageous to store them close to the drilling machine until the individual drilling rods are used.

To store the individual drilling rods, magazine storage systems are known in which it was intended to be possible to successively remove the drilling rods out of the magazine and position them on a drilling mount so that the drilling tool can be screwed. During the process of unscrewing the drilling tool, it was also intended to be possible to receive the rods and guide the drilling rods back into the magazine Pipe magazines comprising chutes or throughput magazines that can be filled from above are for example known from the prior art, whereby inside the chutes or throughput magazines, the force of gravity causes the pipes to fall downwards in a straight line or to move downwards in a meandering shape.

An example of a known device for handling drilling rods is described in WO 96/26349 (see FIG. 13). The known magazine has three vertical chutes 110, 120, 130 in which the drilling rods 100 are received. The drilling rods 100 are supplied to the magazine in a filling position 140 and removed therefrom in a removal position 142. The drilling rods 100 are removed and supplied by means of a gripping arm 144 which is pivotable around a first axis 146 and movable along a second axis 148.

In the magazines known from the prior art, the filling or transportation from the refill position to the removal position occurs as a result of the force of gravity. In such drop chutes and throughput magazines, considerable noise is produced during the process of falling. There is also a risk of the pipes being positioned at an angle during the drop, causing them to twist and get stuck. Lastly, the order of the drilling rods to be used can only be controlled unsatisfactorily since the order of use for the drilling rods located in a chute depends on the order of filling these drilling rods.

DESCRIPTION OF THE INVENTION

By taking the prior art into consideration, the present invention's object is to provide a drilling tool magazine and a horizontal boring machine comprising such a drilling tool magazine in which automatic and reliable handling and access to any of the drilling rods to be handled is ensured.

In accordance with the invention, this object is advantageously solved by a drilling tool magazine described in claim 1. Advantageous extensions of the drilling tool magazine according to the invention are described in the dependent claims. The invention also provides a horizontal boring machine combined with a drilling tool magazine defined in claim 1 and the dependent claims.

The invention is based on the idea of providing a magazine in which the tools or workpieces to be handled are forcibly guided a slight distance apart.

In this way, the drilling tool magazine, comprises in accordance with the invention, a plurality of tool bays so as to receive tools. A tool bay is the space needed for handling a tool or workpiece to be stored in a magazine in the total extension of its longitudinal direction. The longitudinal extension of the tool bays therefore corresponds to the longitudinal extension of the tools to be received, each tool bay receiving one tool respectively. In accordance with the invention, adjacent tool bays are spaced apart by movable drive catches. The distance produced between the drive catches essentially corresponds to the transverse extension of the tools. The spacing creates discrete tool bays which due to the movability of the drive catches can be controlled in such a way as to enable the drilling rods to be successively removed from the magazine and any of the articles stored in the magazine to be systematically accessed. It is also possible for the receiving and refill position of the drilling rods to be identical so that in accordance with the invention a drilling machine's set-up time and the space needed by the drilling tool magazine are decreased. It is likewise possible to apply any control criteria as regards the order of the drilling rods to be used, e.g. first in/first out. Accordingly, different drilling rods can be systematically used such as to ensure even wear of the drilling rods. The forcible guidance in discrete tool bays also stops individual drilling rods from getting stuck and jamming the magazine. The generation of noise to be deplored in the prior art is also advantageously eliminated. At the same time, a compact design for the drilling tool magazine and a high packing density for the drilling tools within the magazine are ensured by spacing individual drilling rods only a slight distance apart.

According to an extension of the drilling tool magazine according to the invention, this magazine is designed as a chain magazine having at least one chain revolving around a magazine axis. In this way, the packing density and hence the capacity of the magazine can be adapted according to requirements as a result of a flexible sectional guidance of the at least one revolving chain.

According to an extension of the invention, the drive catches are detachably coupled to the at least one chain. This consequently makes it possible to adapt the flexibility of the inventive drilling tool magazine even more effectively to different tool diameters. The receiving space of the discrete tool bays can be varied by uncoupling the drive catches from the at least one chain and by subsequently recoupling the drive catches at another site.

To increase further the tool packing density in the drilling tool magazine according to the invention, an extension of the invention provides that the at least one chain revolves in a meandering shape around a plurality of magazine axes.

According to a further embodiment of the invention, the space needed within the drilling tool magazine according to the invention and required when feeding the tools received inside the drilling tool magazine to a downstream drilling mount is reduced in that the longitudinal extension of the tool bays is parallel to the at least one magazine axis.

To increase further the reliability of tool transportation within the drilling tool magazine according to the invention and to ensure optimum stability while simultaneously keeping a simple drive, the chain magazine comprises, in accordance with an extension of the invention, two revolving chains, each of which is disposed next to an end region of the longitudinally extended tool bays. The chains are preferably arranged at the front end directly next to the tool bays.

To be able to remove the tools from the drilling tool magazine and supply them to it, the drilling tool magazine comprises, in accordance with the invention, at least one removal site. This removal site is designed in such a way as to allow removal of the tools from any tool bay at an angle, preferably at a right angle, to the longitudinal extension of this work bay. In consequence, a connecting direction of the tools with the downstream tool holder of a drilling machine is obtained which keeps the connecting time as low as possible since this design makes the distance to be covered small.

To ensure that the tools are rapidly removed from, or rapidly filled into, the drilling tool magazine, the removal position is formed, according to the invention, by a slot-like aperture, the dimensions of which essentially correspond to those of the tool bays. At the same time, the design as a slot-like aperture prevents the entry of foreign bodies, which is also enhanced by a preferred configuration of the aperture on the lower side of the drilling tool magazine.

To take the tools out of or to refill them into the drilling tool magazine, the invention also provides that the drilling tool magazine further comprises at least one feeding means for inserting the tools into, and removing them out of, the tool bays.

Each feeding means is advantageously supported in a revolving manner around a rotary axis, the rotary axis being disposed parallel to the longitudinal extension of the tool bays. The rotating or pivoting movement in conjunction with the arrangement of the rotary axis makes it possible to quickly cover the advantageously short distance due to low moving masses, whereby the strength of the feeding means is high.

The seizure of the tools in the drilling tool magazine according to the invention is formed, in accordance with an extension of the invention, by a receiving member so as to receive the tools in a form-locked manner.

To allow the feeding means to provide a stable hold for the tools, there are two feeding means, each of which is disposed in an end region of the longitudinally extended tool bays.

According to an extension, at least one gripping device is also provided according to the invention for the removal of the tools out of, and their insertion into, the at least one feeding means. This extension makes it possible for the drilling tool magazine to be connected to optimum effect to the downstream drilling machine in the conveyance direction of the tools.

These gripping devices are advantageously supported in a revolving manner around a pivoting axis, this pivoting axis being disposed parallel to the longitudinal extension of the tool bays. The direction of conveyance of the tools to be handled corresponds in this way in the case of the gripping devices to the conveyance direction when directly removing the tools from, or inserting them into, the drilling tool magazine. A change in the type of movement is advantageously avoided and the time interval from removing a tool out of the drilling tool magazine to feeding this tool to the drilling machine is kept to a minimum. According to a preferred extension, the pivoting axis is formed by a shaft or axis common to all gripping devices.

To ensure that the reliability of this operation is as high as possible, the present invention is advantageously extended such that each gripping device comprises a gripping member with which the tools can be seized in a form-locked and/or force-locked manner. The invention provides that the tools are seized only in a form-locked manner, only in a force-locked manner or in a combined form-locked/force-locked manner.

The accuracy of delivery at the interface between feeding means and gripping device is increased according to the invention in that the number of gripping devices corresponds to the number of feeding means. The gripping devices are ideally located close to the feeding means.

To achieve a symmetrical structure of the drilling tool magazine according to the invention, which further increases the accuracy of delivery, an extension of the invention provides two gripping devices, one each in an end region of the longitudinally extended tool bays.

To facilitate the operation of the drilling tool magazine according to the invention, particularly during the process of removing the drilling rods, the at least one chain is driven. The drive advantageously comprises a motor in combination with a switching free-wheel and a slip hub, whereby these components act upon the at least one chain. Yet it is also possible to use a hydraulic, pneumatic or electric motor optionally in conjunction with gears.

The drive catches are used to guide the tools within the drilling tool magazine according to the invention in the direction of tool conveyance through the magazine. On those planes parallel to the conveyance direction, the conveyance path of the tools inside the drilling tool magazine is limited by guide walls. This embodiment of the invention ensures reliable guidance while maintaining a simple structure and hence keeping production costs low.

BRIEF DESCRIPTION OF THE DRAWINGS

To explain the invention further and understand it better, an exemplary embodiment will now be described and discussed in more detail with reference to the attached drawings.

FIG. 8 shows the removal site of the drilling tool magazine, with a feeding means also being schematically depicted in the figure;

FIGS. 9, 10 and 11 show a removal operation of a drilling rod by the feeding means in the operating sequence;

DESCRIPTION OF AN EXEMPLARY EMBODIMENT

Figure 1:
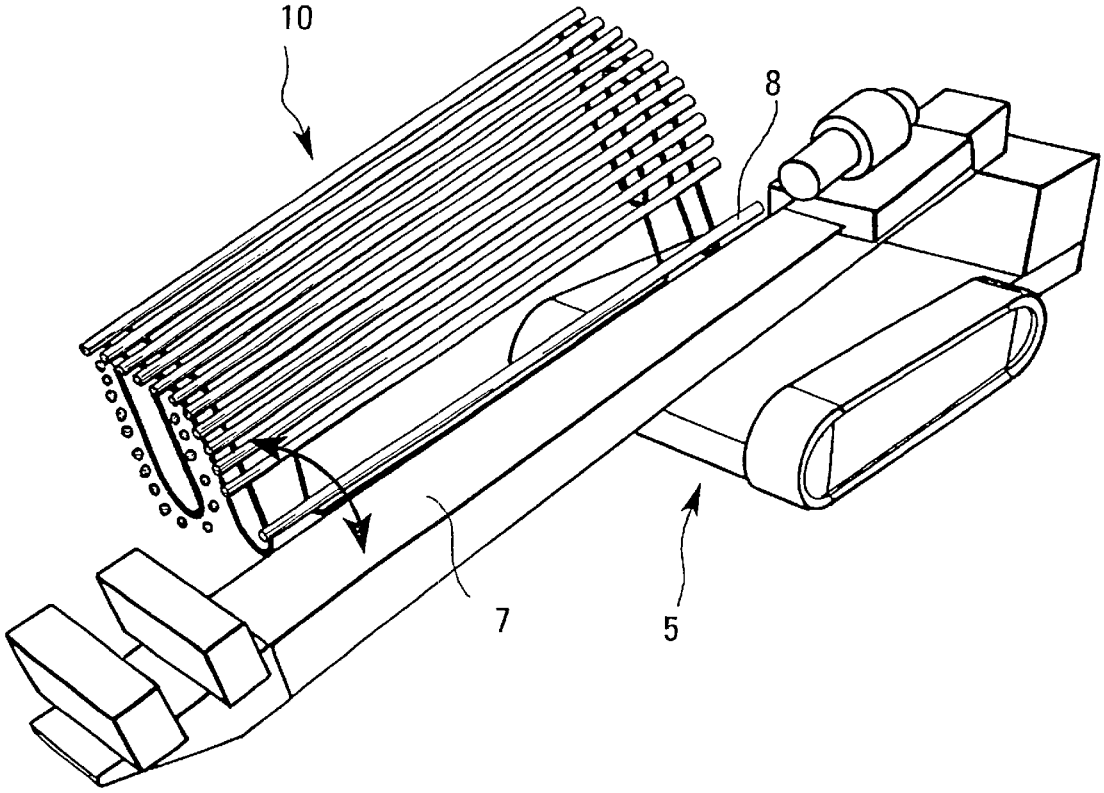
FIG. 1 shows a perspective view of a horizontal boring machine with a schematically depicted drilling tool magazine according to the invention.

FIG. 1 shows a typical application of a drilling tool magazine 10 of the present invention in combination with a horizontal boring machine 5. The drilling tool magazine 10 is secured to a drilling mount 7 such that when looking in the longitudinal direction of the drilling mount, the magazine is disposed at the side of the mount and when looking in the transverse direction of the mount, the magazine is disposed above same. As depicted in FIG. 1, the removal of the individual drilling rods 8 takes place at that side of the drilling tool magazine 10 which is directly adjacent to the drilling mount 7.

Figure 2:
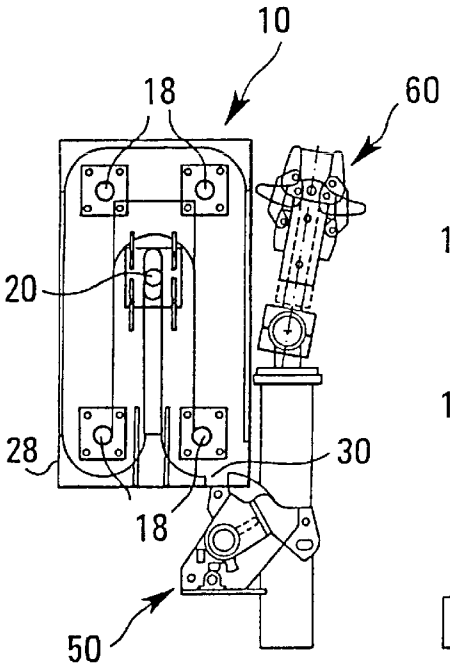
FIG. 2 shows a front view of a drilling tool magazine according to the invention, with a feeding means and a gripping device also being depicted in the figure.

The drilling tool magazine 10 is provided with a feeding means 50 and a gripping device 60 (see FIG. 2). The feeding means 50 is used to remove the drilling rods from the drilling tool magazine 10 at the removal site 30, and to re-insert the drilling rods into the drilling tool magazine 10 at this removal site 30. The gripping device 60 is disposed at the same side of the drilling tool magazine 10 as the feeding means 50. The drilling tool magazine 10 itself is designed as a chain magazine in the exemplary embodiment described and illustrated. The chain guide or chain drive is disposed in a housing 28 and comprises four fixed magazine axes 18 and a movable magazine axis 20 in the exemplary embodiment. Chain wheels (not shown in FIG. 2) are arranged around the various magazine axes 18, 20. In the depicted embodiment, the movable magazine axis 20 simultaneously serves as a drive shaft for the drilling tool magazine. The movability of the drive shaft in the exemplary embodiment depicted and described ensures that the chains 16 (see also FIG. 3) of the chain drive can be tensioned.

Figure 3:
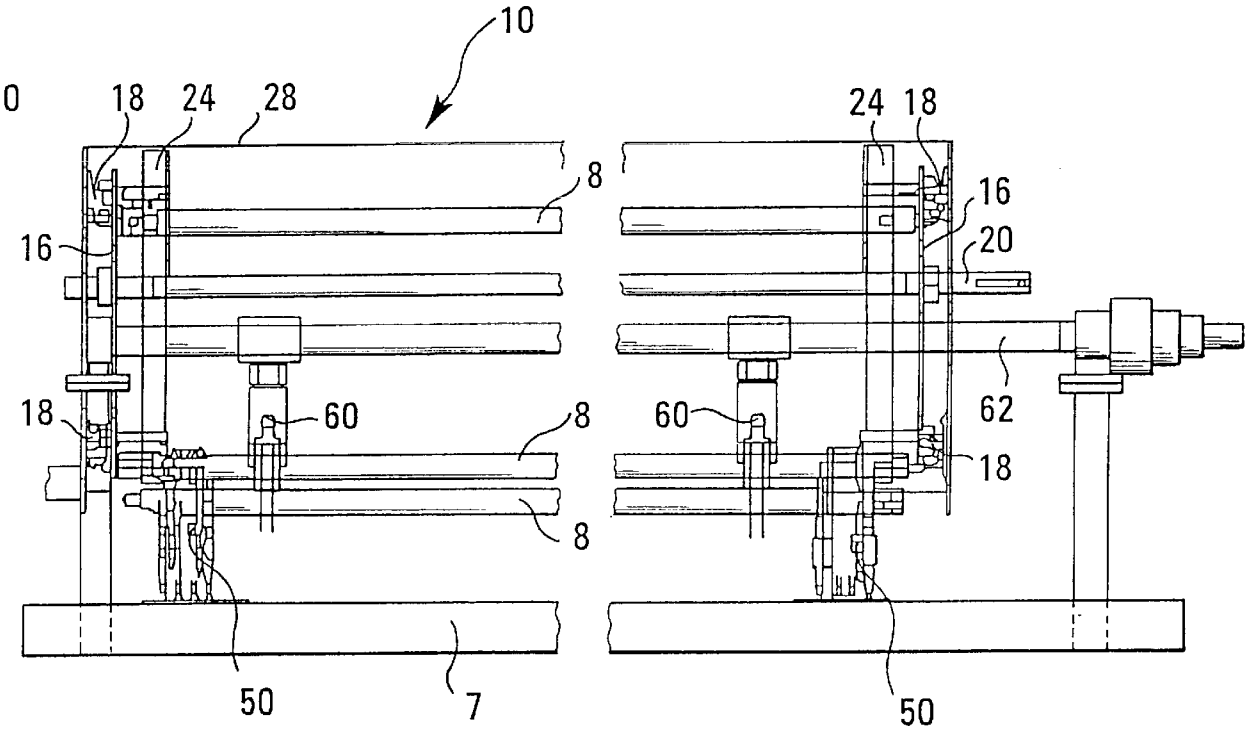
FIG. 3 shows a side view corresponding to FIG. 2.

FIG. 3 is a side view corresponding to FIG. 2, although FIG. 3 depicts the gripping devices 60 in a different position from that in FIG. 2. The arrangement of the various components of the chain magazine relative to the feeding means 50 and gripping devices 60 is particularly apparent from FIG. 3. The feeding means 50 are disposed at the lower side of the drilling tool magazine 10 in the end regions thereof. The distance between the two depicted feeding means 50 approximately corresponds to the length of the drilling rods 8. Two gripping devices 60 are also located in the end regions. The two gripping devices 60 are slightly inwardly offset in relation to the feeding means 50, thus avoiding a collision of the gripping devices 60 with the respectively adjacent feeding means 50. The drive of the gripping devices 60 and the feeding means 50 is uncoupled, whereby the drive of the feeding means 50 is effected via hydraulic rams 36 that can be more effectively deduced from FIGS. 9 to 11, and the drive of the gripping devices 60 is effected via a common pivoting axis 62 which is designed here as a driven shaft.

The two chains 16 of the drilling tool magazine 10 extend on vertical planes directly adjacent to the end faces of the drilling rods 8 to be stored in the magazine. The chains 16 run over fixed magazine axes 18 and a movable magazine axis 20, in this instance the drive shaft. Chain wheels are supported on the axes 18, 20.

Sheet-metal guides 24 are also inserted in the end regions of the drilling tool magazine 10 and inwardly spaced from the chains 16. These sheet-metal guides 24 are securely connected to the housing 28 of the drilling tool magazine 10 and extend parallel to the plane of the chains 16. The housing 28 can be designed as an open frame structure or as an enclosed version.

Figure 4:
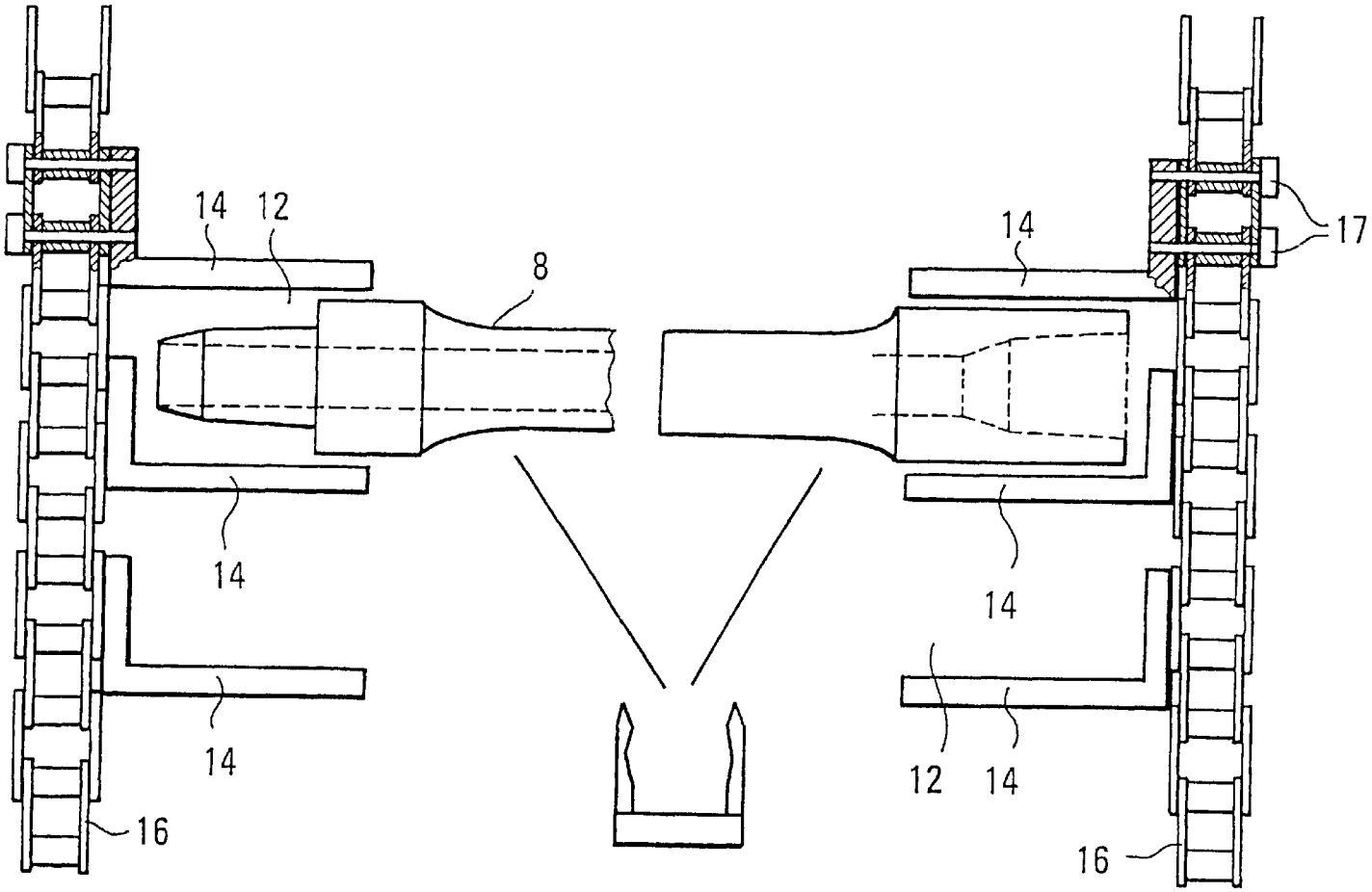
FIG. 4 shows the structure of an exemplary embodiment of the drilling tool magazine as a chain magazine comprising drive catches, with a drilling rod also being schematically depicted in the figure.

FIG. 4 shows details of how the drilling rods 8 are received in the chain magazine. Two chains 16 are represented on the outside of a schematically depicted drilling rod 8. A plurality of drive catches 14 are secured at even intervals to the chains 16 via fastening pins 17. The inside width between adjacent drive catches 14 corresponds to the outer diameter of the maximum-diameter drilling rod 8 to be received plus a clearance for easier removal/reinsertion of the drilling rods 8 from/into the drive catches 14. In relation to the drilling rods 8, the drive catches 14 form pocket-shaped carriers in which the drilling rods 8 securely rest largely regardless of their diameter.

Although it is not absolutely necessary in the preferred embodiment of the invention, it can be ensured by fastening the drive catches 14 to the chains 16 via pins 17 that the drilling tool magazine can optionally be reset to receive drilling rods 8 of a different diameter. For this purpose, only the pins 17 would be taken out of the chains, and the drive catches 14 would be correspondingly offset.

The chain links are designed to be hollow in the articulated regions so as to receive the pins 17. The spacing of the chains 16 relative to one another essentially corresponds to the length of the drilling rods 8 to be received plus a clearance for easier removal of the drilling rods 8 from the drive catches 14 or for their easier reinsertion into same.

Figure 5:
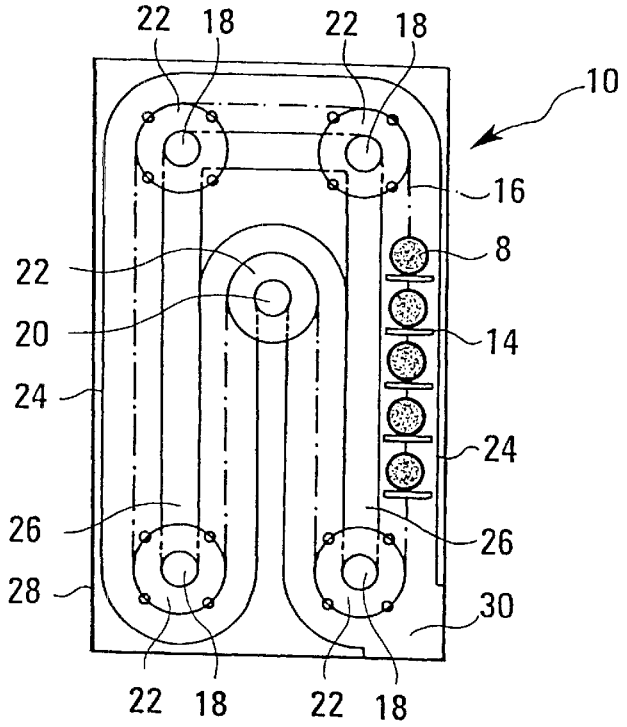
FIG. 5 shows details of the drilling tool magazine in a schematic sectional view.

The front view of FIG. 5 gives an impression of the conveyance path of the drilling rods 8 within the drilling tool magazine 10. The drilling rods 8 are supported on the drive catches 14 which are in turn coupled to the chains 16 in the manner described above, though just one of these chains is shown in FIG. 5. The chain 16 runs over chain wheels 22 around the magazine axes 18, 20. During conveyance along the conveyance path, the drilling rods 8 are guided by lateral guides 24, 26, whereby a forcible guidance of the drilling rods is ensured at the sides by the outer guide wall 24 and the inner guide wall 26 and is ensured in or against the direction of conveyance by the drive catches 14 on the one side or other of a drilling rod 8. On their conveyance path, the drilling rods 8 pass a removal site 30 which, as already mentioned, is preferably disposed on a lower side of the drilling tool magazine 10, thus preventing objects from undesirably falling into the chain drive of the drilling tool magazine 10. It is also beneficial, as can be gathered from FIG. 5, for the removal aperture 30 to be located in the region of a chain wheel 22. This arrangement in the region of the change of movement of the chain 16 ensures that the drive catches 14, via their tilting movement, make it possible for the drilling rods 8 to be accessed more easily (see also FIG. 8).

In the exemplary embodiment depicted, the chain 16 extends in a meandering shape from a fixed magazine axis around the movable magazine axis 20 and back again to a fixed magazine axis 18. This sectional guidance of the chain 16 enables a high packing density of the drilling rods 8 in the drilling tool magazine 10, thus utilizing the space of the drilling tool magazine to good effect.

Figure 6:
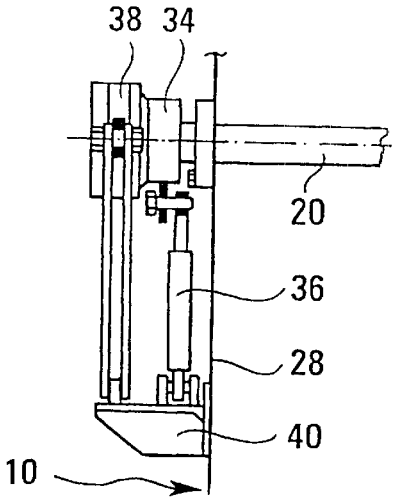
FIG. 6 shows details of the magazine drive in a side view.
Figure 7:
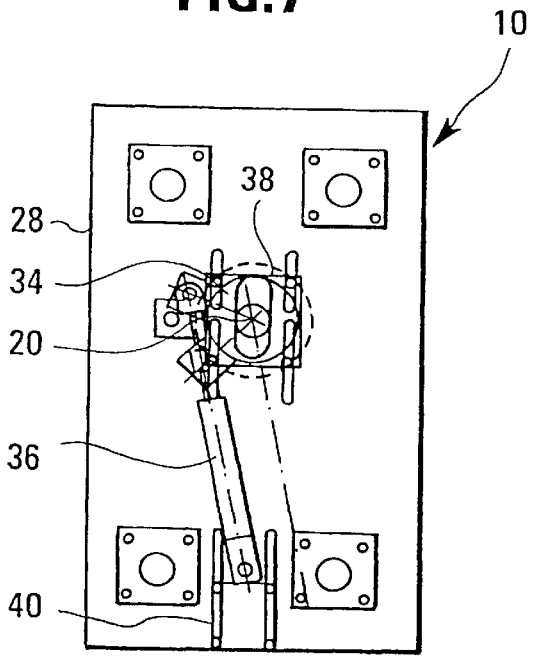
FIG. 7 shows a front view corresponding to FIG. 6.

FIGS. 6 and 7 represent the structural-design solution for the gradual and optional actuation of the chain-magazine drive. The manner in which the drive shaft 20 is guided through the housing 28 of the drilling tool magazine 10 can be gathered from the side view of FIG. 6. At the outside of the drilling tool magazine 10, a switching free-wheel 34 engages with the drive shaft 20. The shaft 20 is driven by actuating the switching free-wheel via the depicted hydraulic ram 36 as a result of pivoting the switching free-wheel 34, or the shaft is fixed in its neutral position by means of the slip hub 38. The drive of the shaft 20 causes the drilling rods 8 to be conveyed further in the drilling tool magazine 10, the fixation of the shaft 20 by the slip hub 38—as a result of the form-locked connection via the chain wheels 22 and the chain 16—causes the drive catches 14 and hence the drilling rods 8 to be immovable relative to the removal aperture 30. The removal and reinsertion operations can be reliably performed in this way. The hydraulic ram 36 rests on a base 40 which is flange-mounted to the housing 28.

The removal and reinsertion operations of the drilling rods 8 from and into the drilling tool magazine 10 is evident to best effect from FIGS. 8 to 11, which will be referred to below. FIG. 8 shows the arrangement of the feeding means 50 relative to the removal aperture 30 of the drilling tool magazine 10 in the locked state. The feeding means 50 comprises a bearing bracket 51 and a rocker arm 52. The rocker arm 52 is supported in the bearing bracket 51 via a pivoting axis 53.

These and other pivoting axes of the invention can also be formed as rotary axes without departing from the scope of the invention.

The rocker arm 52 has an insertion edge 55 at its end facing the removal aperture 30. This insertion edge 55 is shaped such as to continue the guidance by the outer guide wall 24 essentially without gaps when the feeding means 50 is in its locked state. If the chain 16 with the drive catches 14 that are fastened to same via the pins 17 and with the drilling rods 8 received between the drive catches moves downwards to the right in FIG. 8, the drilling rod 8 is guided laterally by the outer guide wall 24 in the vertical part of the conveyance path. When the chain 16 is deflected around the chain wheel 22, the drive catches 14 tilt relative to the surroundings. The force of gravity would cause the drilling rods 8 to fall out of the tool bays from a certain angle of inclination of the base of the drive catches 14. When the feeding means 50 are in the locked state, the insertion edge 55 nevertheless continues the guidance of the outer guide wall 24, with the result that the drilling rods 8 would only fall out of the tool bays if the insertion edge 55 released the removal site 30.

The removal process is most easily evident from FIGS. 9, 10 and 11 as follows. As soon as the drilling rods 8 pass the removal site 30, they make contact with the insertion edge 55 of the rocker arm 52. A hook 56 is supported in a rotating manner around a pivoting axis 57 in the region of the insertion edge 55. The hook 56 is also guided with a pin in a sliding guide 58 of the rocker arm 52. A hydraulic ram disposed between the pin and the bearing bracket 51 simultaneously engages with the pin. The hydraulic ram is schematically depicted in the figures by a dot-dashed line. The rocker arm 52 is connected to the bearing bracket 51 via a spring 54 at that side opposite the hydraulic ram relative to the pivoting axis 53 (FIG. 9). An initial actuation of the hydraulic ram (FIG. 10) first causes the hook 56 to rotate around its axis 57 and causes the pin of the hook 56 to move in the sliding guide 58 of the rocker arm from the one to the other end. The hook-shaped receiving member appears and encompasses in a form-locked manner the drilling rod 8 resting on the insertion edge 55 of the rocker arm. The rocker arm 52 is held in position by the spring 54. If the hydraulic ram is actuated further (FIG. 11), the pin that strikes in the sliding guide 58 at the lower end acts upon the rocker arm 52 and causes it to tilt around its pivoting or rotary axis, drawing the drilling rod 8 out of the magazine 10. In the rocker arm's pivoted position, the drilling rod 8 is held between the hook-shaped receiving member of the hook 56 and another edge. The drilling rod can be seized in this position and removed from the feeding means 50. In the pivoted position of the feeding means 50, the chain drive is locked so that no more drilling rods 8 can fall out via the removal aperture 30.

Figure 12:
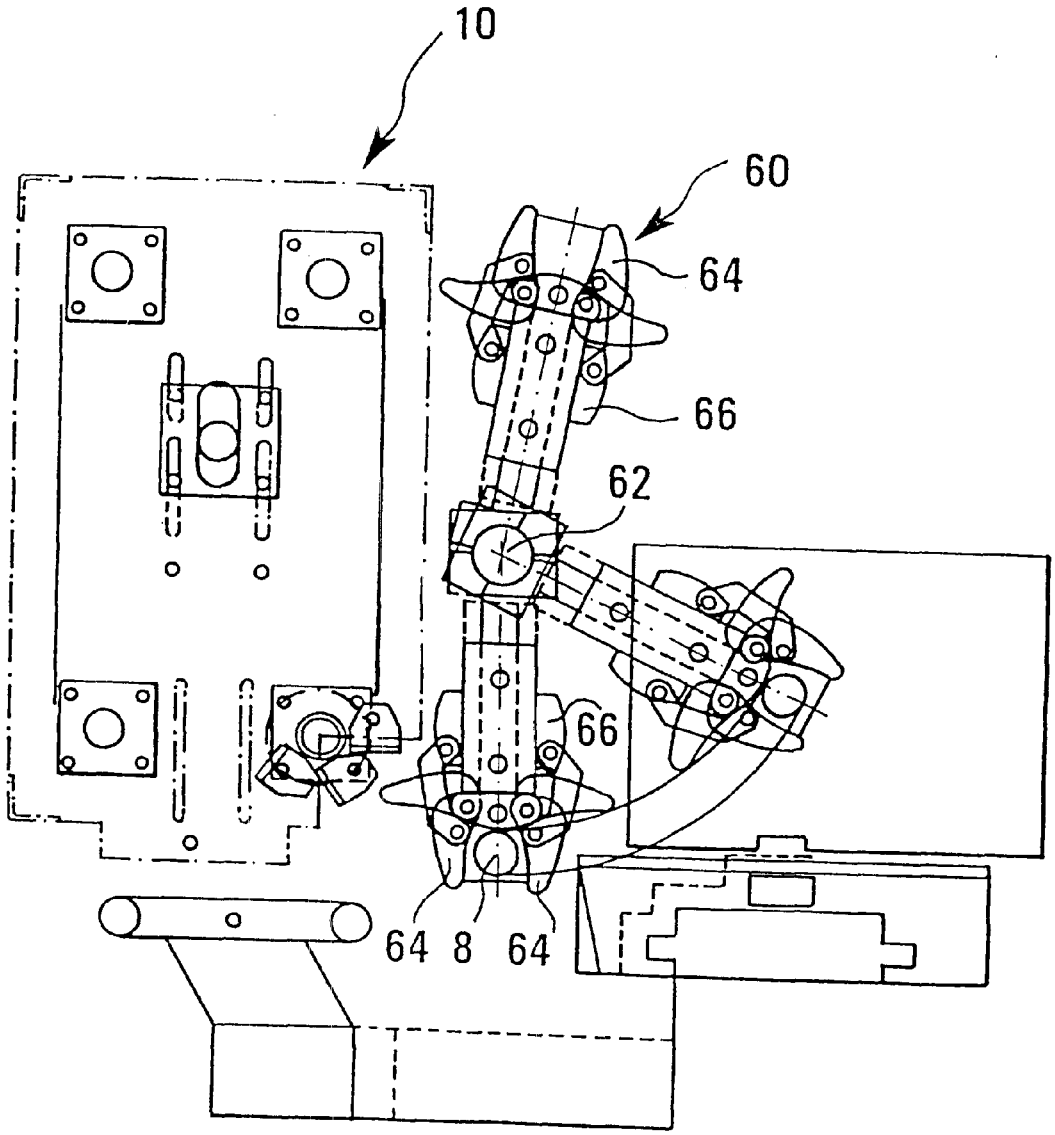
FIG. 12 shows a gripping device used in the drilling tool magazine according to the invention.
Figure 13:
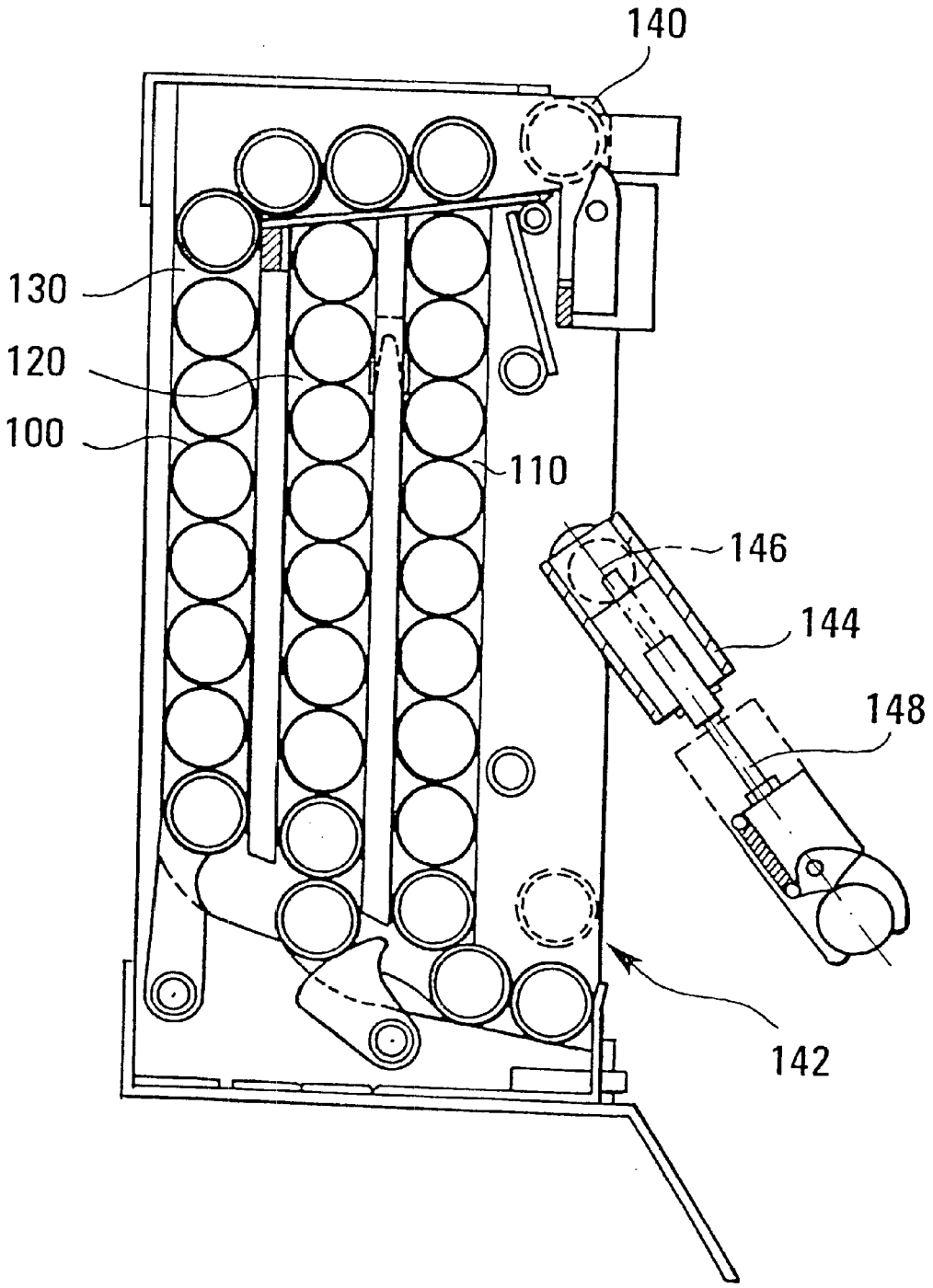
FIG.13 PRIOR ART
FIG. 13 shows a device known from the prior art.

FIG. 12 represents the seizure of the drilling rods by the gripping devices 60. The rotational movability of the gripping device 60 can be deduced from the figure. In this particular case, the gripping device 60 is coupled to the pivoting axis 62 such that the gripping device 60 is also moved upon rotary actuation of the pivoting axis 62. The gripping device 60 is fitted with gripping members 64 at its end remote from the pivoting axis 62. The gripping members are in turn pivotably supported in the end region of the gripping device 60 and are coupled to an actuating slide 66. Shifting the actuating slide 66 along the gripping device 60 causes the gripping members 64 to open and close. The actuating slide 66 can be advantageously operated hydraulically or pneumatically. The gripping members 64 are designed such as to be able to receive the drilling rods 8 in a form-locked and force-locked manner. Form locking is accomplished by a recess-like formation on the inside of the gripping members 64, force locking is obtained by the continuous actuation of the actuating slides 66 in the direction of closure while the drilling rod 8 is being held.

The actuation of the drilling tool magazine 10 will now be explained.

Based on the position shown in FIG. 5, the switching free-wheel 34 (FIG. 6) and the slip hub 38 are actuated via the hydraulic ram 36 in order to remove the very bottom drilling rod 8. Actuation causes the drive shaft 20 in FIG. 5 to rotate anticlockwise and causes the very bottom drilling rod 8 which is to be removed to move downwards toward the removal site 30. At this point in time, the removal site 30 is closed by the insertion edge 55 of the feeding means 50 (see FIG. 8). As soon as the drilling rod 8 to be removed has reached the removal site—see FIG. 8—the hydraulic ram of the feeding means 50 is actuated so that first the hook 56 emerges from the insertion edge 55 of the rocker arm (see FIG. 10), whereupon the rocker arm 52 pivots around its pivoting axis 53 into the position shown in FIG. 11. At this point in time, the gripping device 60 (see FIG. 12) is not in the position that points vertically downwards, with the result that no collision with the movement of the feeding means 50 arises. As soon as the feeding means 50 have reached the position shown in FIG. 11, the gripping device 60 pivots around the pivoting axis 62 into the position that faces vertically downwards, with the gripping members 64 being pivoted upwards. The actuating slides 66 (FIG. 12) are then actuated and the gripping members 64 closed around the drilling rod 8 to be removed. The gripping device 60 is then pivoted around the pivoting axis 62 and moved to the desired position in which the drilling rod 8 can be screwed with the drilling tool on the drilling mount 7 (not shown). The reinsertion of the drilling rods 8 into the magazine 10 correspondingly occurs in reverse order.

These and other actuation steps are advantageously controlled by a control device not shown here.

What is claimed is:

1. A drilling rod magazine for horizontal boring machines comprising:

a plurality of tool bays selectively accessible for receiving or removing drilling rods, said tool bays each being formed by at least one drive catch movable along a conveyance path, each drive catch being coupled to a chain, a plurality of fixed magazine axis and at least one moveable magazine axis that is movable relative to the plurality of fixed magazine axis; and at least one chain revolving around the plurality of fixed magazine axis and the at least one moveable magazine axis.

2. A drilling rod magazine according to claim 1, wherein said drive catches are coupled to said at least one chain.

3. A drilling rod magazine according to claim 2, wherein said tool bays are aligned parallel to said at least one fixed magazine axis or said at least one movable magazine axis.

4. A drilling rod magazine according to claim 2, wherein said chain magazine comprises two revolving chains, each of said chains being disposed next to an end region of said tool bays.

5. A drilling rod magazine according to claim 1, wherein said drilling tool magazine comprises at least one removal site enabling said tools to be removed from each tool bay at an angle.

6. A drilling tool magazine according to claim 5, wherein said removal site is formed by an aperture having dimensions corresponding to those of said tool bays.

7. A drilling tool magazine according to claim 1, wherein said drilling tool magazine further comprises at least one feeding means for inserting and removing said tools into and out of said tool bays.

8. A drilling tool magazine according to claim 7, wherein each feeding means is supported in a rotating manner around a rotary axis, said rotary axis being disposed parallel to said tool bays.

9. A drilling tool magazine according to claim 7, wherein each feeding means (50) comprises a receiving member (56) for receiving the tools in a form-locked manner.

10. A drilling tool magazine according to claim 7, wherein two feeding means are provided, each of said feeding means being disposed in an end region of said drilling tool magazine.

11. A drilling tool magazine according to claim 7, wherein at least one gripping device is also provided for removing and inserting the tools out of and into said at least one feeding means.

12. A drilling tool magazine according to claim 1, wherein said drilling tool magazine further comprises at least one feeding means for inserting and removing said tools into and out of said tool bays; and at least one gripping device, each gripping device supported in a rotating manner around a pivoting axis, said pivoting axis being disposed parallel to said tool bays.

13. A drilling rod magazine according to claim 12, wherein each gripping device comprises a gripping member with which the tools can be seized in a form-locked and/or force-locked manner.

14. A drilling rod magazine according to claim 12, wherein the number of gripping devices corresponds to the number of feeding means.

15. A drilling rod magazine according to claim 12, wherein two gripping devices are provided, one of said gripping devices at a time being disposed in an end region of said drilling rod magazine.

16. A drilling rod magazine according to claim 1, wherein said tool bays are delimited by guide walls, said guide walls being located parallel to said tool bays.

17. A drilling rod magazine according to claim 1, wherein said drilling rod magazine further comprises a motor drive which acts upon said at least one chain.

18. A drilling rod magazine according to claim 17, wherein said drive acts upon said at least one chain via a switching free-wheel.

19. A drilling rod magazine according to claim 1, in combination with a horizontal boring machine.

* * * * *